US005101800A

United States Patent [19]

Schumann et al.

[11] Patent Number: 5,101,800

[45] Date of Patent: Apr. 7, 1992

[54] FUEL INJECTION

[75] Inventors: David R. Schumann, Rochester; Marty M. Hoch, Webster, both of N.Y.

[73] Assignee: General Motors Corporation, Detroit, Mich.

[21] Appl. No.: 624,109

[22] Filed: Dec. 7, 1990

[51] Int. Cl.[5] ..... F02M 69/08; F02M 55/00; F02M 67/02

[52] U.S. Cl. ..... 123/531; 123/456; 239/408; 239/585.3

[58] Field of Search ..... 123/478, 456, 531, 533; 239/585, 408

[56] References Cited

U.S. PATENT DOCUMENTS

| | | | |
|---|---|---|---|
| Re. 27,909 | 2/1974 | Huber | 123/478 |
| 1,117,738 | 11/1914 | Winton | 123/531 X |
| 1,288,439 | 12/1918 | Pattinson | 123/533 |
| 4,590,911 | 5/1986 | Sciotti et al. | 123/468 |
| 4,768,720 | 9/1988 | Cocca | 239/533.11 X |
| 4,776,516 | 10/1988 | Klomp | 239/87 |
| 4,823,756 | 4/1989 | Ziejewski et al. | 123/531 |
| 4,841,942 | 6/1989 | McKay | 123/533 |
| 4,909,220 | 3/1990 | Field et al. | 123/468 |
| 4,925,112 | 5/1990 | Wahba | 239/585 |
| 4,934,329 | 6/1990 | Lear et al. | 123/531 |
| 4,958,773 | 9/1990 | Stettner et al. | 239/585 X |
| 4,958,774 | 9/1990 | Taylor | 239/585 X |
| 4,978,074 | 12/1990 | Weinand | 239/585 |
| 4,986,247 | 1/1991 | Kushibe et al. | 123/533 |

*Primary Examiner*—Tony M. Argenbright
*Attorney, Agent, or Firm*—Charles K. Veenstra

[57] ABSTRACT

A single fuel metering injector directs fuel through a plurality of nozzles to a plurality of charge delivery injectors.

1 Claim, 2 Drawing Sheets

FUEL INJECTION

TECHNICAL FIELD

This invention relates to a system for delivering a fuel-air charge to an engine, and to a system particularly adapted for delivering a fuel-air charge directly into an engine combustion chamber.

BACKGROUND

Systems under current consideration for delivering a charge of fuel and air directly into a plurality of engine combustion chambers employ a plurality of charge delivery injectors and a plurality of fuel metering injectors—one fuel metering injector for each charge delivery injector. Air is supplied to the charge delivery injectors, each fuel metering injector is energized to direct a metered quantity of fuel to its charge delivery injector, and each charge delivery injector is energized to deliver a charge of fuel and air directly into its associated combustion chamber.

SUMMARY OF THE INVENTION

This invention provides a fuel injection system having a single fuel metering injector that directs fuel through a plurality of nozzles to a plurality of charge delivery injectors. Use of a single fuel metering injector simplifies metering of fuel to the charge delivery injectors and allows a reduction in the size of the system, and the nozzles are constructed to enhance delivery of fuel to the charge delivery injectors and to protect the fuel metering injector.

The details as well as other features and advantages of a preferred embodiment of the fuel injection system provided by this invention are set forth in the remainder of the specification and are shown in the accompanying drawings.

THE PREFERRED EMBODIMENT

Figure 1:
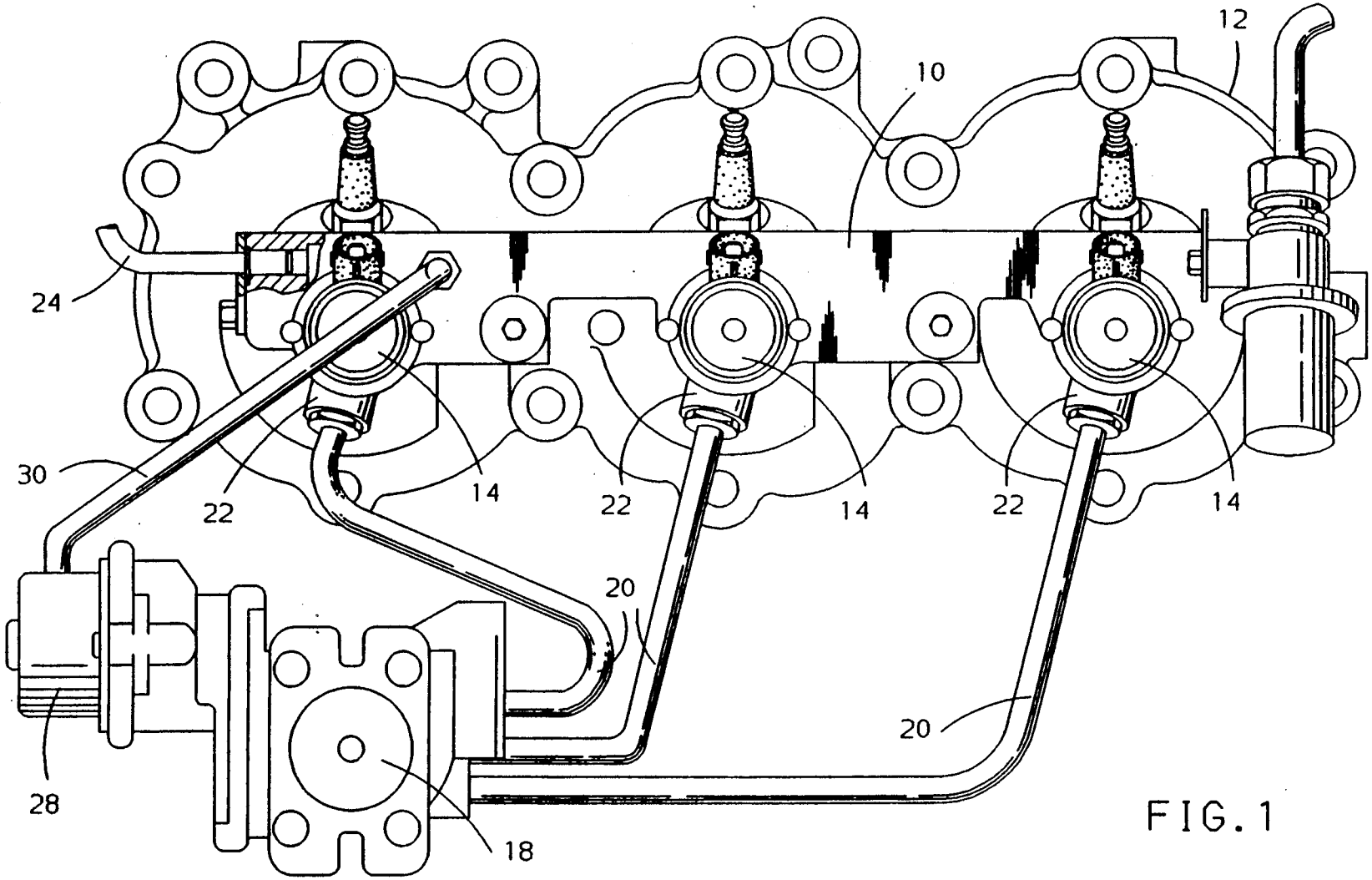
FIG. 1 is a plan view of this fuel injection system installed on a two-stroke engine.

Referring to the drawings, a fuel-air rail 10 is installed on a three cylinder two-stroke engine 12.

Three charge delivery injectors 14 are supported in rail 10, and each injector 14 has a tip 16 that projects into an engine combustion chamber.

A single fuel metering injector 18 directs fuel through three fuel lines 20 to three nozzles 22 supported in rail 10 adjacent charge delivery injectors 14.

A tube 24 supplies air to an air passage 26 formed in rail 10. A pressure regulator 28 has a connection 30 to sense the air pressure in passage 26; pressure regulator 28 controls the pressure of the fuel supplied to fuel metering injector 18 in response to the pressure of the air in passage 26.

Charge delivery injectors 14 employ features of the injector set forth in U.S. Pat. No. 4,978,074 in the name of L. W. Weinand; the disclosure of that patent is incorporated by reference.

Fuel metering injector 18 employs features of the injector set forth in U.S. Pat. No. 4,958,774 in the name of R. S. Taylor; the disclosure of that patent is incorporated by reference.

Nozzles 22 employ features of the nozzle set forth in U.S. Pat. No. 5,070,845 in the name of A. Avdenko et al; the disclosure of that patent is incorporated by reference.

Figure 2:
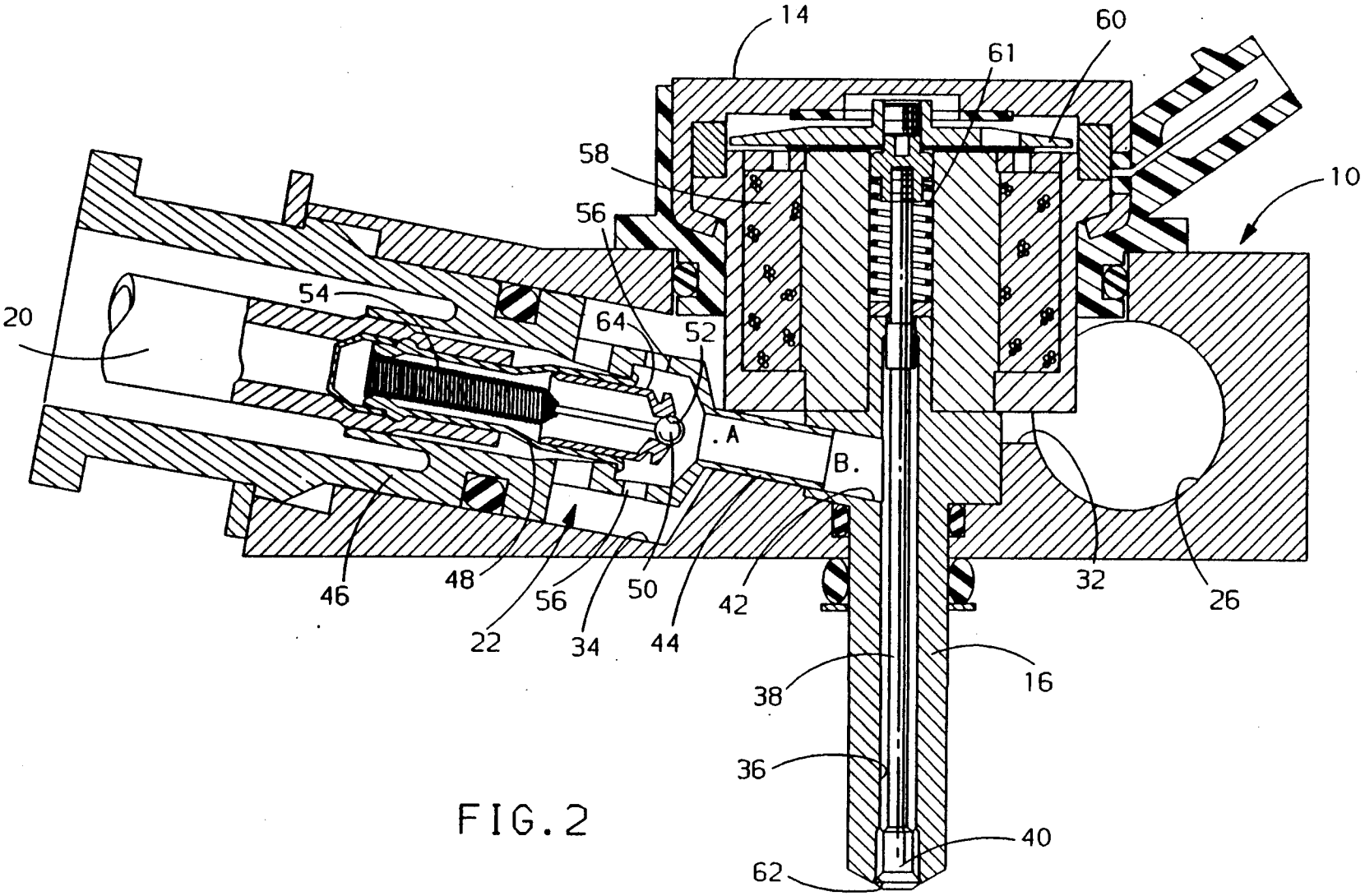
FIG. 2 is a sectional view through the fuel rail of the FIG. 1 fuel injection system, showing a fuel nozzle and a charge delivery injector.

As shown in FIG. 2, air passage 26 intersects chambers 32 that receive charge delivery injectors 14, and nozzles 22 are received in bores 34 opening into chambers 32.

The tip 16 of each charge delivery injector 14 has a central bore 36 surrounding the stem 38 of a valve 40 and a window 42 opening laterally into bore 36. Each nozzle 22 has an extension 44 guided into a window 42.

Each extension 44 projects from a nozzle holder 46 guided in a bore 34. Each nozzle holder 46 supports a nozzle subassembly 48 which is received in the end of a fuel line 20. When fuel metering injector 18 directs fuel through fuel lines 20, the increased fuel pressure within each nozzle subassembly 48 displaces a ball valve 50 from a valve seat 52 against the bias of an extension spring 54, and each nozzle subassembly 48 delivers fuel through extension 44 and window 42 into bore 36.

Each charge delivery injector 14 has a solenoid coil 58 which, when energized, moves an armature 60 against the bias of a spring 61 to displace valve 40 from its seat 62. With valve 40 displaced from seat 62, air flows from passage 26 through chamber 32, bore 34, lateral apertures 56 in nozzle holder 46, extension 44, window 42 and bore 36 into the engine combustion chamber—carrying the fuel from bore 36 into the engine for combustion.

Apertures 56 direct the air flow inwardly toward the sides of the tip 64 of each nozzle subassembly 48, and the resulting air flow pattern enhances delivery of fuel from the nozzle subassembly through extension 44 and window 42 into bore 36.

In prior systems, the fuel metering injector was located closely adjacent the charge delivery injector and accordingly was exposed to whatever gases might enter the tip of the charge delivery injector from the combustion chamber. In those prior systems, moreover, the inwardly opening valve of the fuel metering injector could allow those combustion gases to enter the fuel metering injector. With this system, however, the fuel metering injector 18 is located remotely from the charge delivery injector 14, and the outwardly opening valves 50 of the nozzle subassemblies 48 protect the fuel metering injector 18 from combustion chamber gases that might enter the tips 16 of the charge delivery injectors 14.

The tip 64 of nozzle subassembly 48 is smaller than the tip of the fuel metering injector previously employed to deliver fuel into a charge delivery injector. Accordingly it is anticipated that it will be possible to reduce the size of nozzle holder 46 and thereby reduce the size of rail 10.

Because the tip 64 of nozzle subassembly 48 is smaller than the tip of the fuel metering injector previously employed to deliver fuel into a charge delivery injector, it also is anticipated that it will be possible to place nozzle subassembly 48 closer to the tip 16 of charge delivery injector 14 than has been achieved with a fuel metering injector. Placing the tip 64 of nozzle subassembly 48 closer to the tip 16 of charge delivery injector 14 may enhance delivery of fuel from the nozzle subassembly through extension 44 and window 42 into bore 36.

Moreover, it will be appreciated that this system requires only one fuel metering injector to deliver fuel to a plurality of charge delivery injectors. It is anticipated that only one fuel metering injector would be required for a six cylinder engine employing six charge delivery injectors. This invention accordingly provides the synergy of a fuel injection system having a single fuel metering injector that meters and directs fuel through fuel lines to a plurality of nozzles, with a fuel injection system having a charge delivery injector that delivers a charge of fuel and air directly into an engine combustion chamber.

It will be appreciated that although this fuel injection system is particularly adapted for direct injection of fuel and air into the combustion chamber of a two-stroke engine, it also is suitable for direct injection in a four-stroke engine and for other fuel injection applications.

We claim:

1. A fuel injection system including a rail supporting a charge delivery injector and a fuel nozzle, the rail forming a chamber receiving the charge delivery injector and a bore receiving the fuel nozzle, the bore and the chamber being interconnected, the rail further including a passage for supplying air to the chamber and the bore, the charge delivery injector having a charge delivery valve supported on a valve stem and having a spray tip with a bore surrounding the valve stem, the spray tip having a lateral window opening from the nozzle receiving bore into the spray tip bore, the nozzle being aligned to deliver fuel through the window into the spray tip bore, wherein upon opening of the charge delivery valve air flows from the air passage through the nozzle receiving bore, the window and the spray tip bore and a charge of fuel and air is delivered from the spray tip, and wherein the fuel nozzle has a tip projecting into the nozzle receiving bore whereby air is directed inwardly toward the sides of the nozzle tip and the resulting air flow pattern enhances delivery of fuel from the nozzle through the window into the spray tip bore.

* * * * *